US006774844B2

(12) United States Patent
Subotic et al.

(10) Patent No.: US 6,774,844 B2
(45) Date of Patent: Aug. 10, 2004

(54) ANTENNA STRUCTURES BASED UPON A GENERALIZED HAUSDORFF DESIGN APPROACH

(75) Inventors: Nikolas Subotic, Ann Arbor, MI (US); Christopher Roussi, Augusta, MI (US); Joseph Burns, Ann Arbor, MI (US)

(73) Assignee: Altarum Institute, Ann Arbor, MI (US)

( * ) Notice: Subject to any disclaimer, the term of this patent is extended or adjusted under 35 U.S.C. 154(b) by 0 days.

(21) Appl. No.: 10/216,602

(22) Filed: Aug. 9, 2002

(65) Prior Publication Data

US 2003/0052818 A1 Mar. 20, 2003

Related U.S. Application Data

(60) Provisional application No. 60/311,267, filed on Aug. 9, 2001.

(51) Int. Cl.[7] ..... H01Q 3/02; H01Q 3/12

(52) U.S. Cl. ..... 342/374; 343/700 MS

(58) Field of Search ..... 342/374; 343/700 MS

(56) References Cited

U.S. PATENT DOCUMENTS

| | | | | |
|---|---|---|---|---|
| 5,848,198 A | * | 12/1998 | Penn | 382/276 |
| 6,104,349 A | | 8/2000 | Cohen | 343/702 |
| 6,107,975 A | | 8/2000 | Brennan et al. | 343/853 |
| 6,127,977 A | | 10/2000 | Cohen | 343/700 MS |
| 6,140,975 A | | 10/2000 | Cohen | 343/846 |
| 6,300,914 B1 | * | 10/2001 | Yang | 343/741 |
| 6,392,610 B1 | * | 5/2002 | Braun et al. | 343/876 |
| 6,525,691 B2 | * | 2/2003 | Varadan et al. | 343/900 MS |

OTHER PUBLICATIONS

Romeu, J. and Rahmat–Samii, Y., Fractal Elements and Their Applications to Frequency Selective Surfaces, Aerospace Comference Proceedings, 2000 IEEE, vol. 5, Mar. 18–25, 2000, pp. 77–81 vol. 5.*

IEEE Microwave Tehory and Techniques Society, Sponsor. IEEE Antennas and Propagation Society, sponsor "Frontiers In Electromagnetics," Douglas H. Werner and Raj Mittra.

* cited by examiner

*Primary Examiner*—Theodore M. Blum
(74) *Attorney, Agent, or Firm*—Gifford, Krass, Groh, Sprinkle, Anderson & Citkowski, PC

(57) ABSTRACT

An approach to antenna design optimizes gain, beam pattern, polarization response, and other qualities through self-replicating patterns based upon iterative transformations and candidate geometric shapes. In the preferred embodiment Hausdorff structures are used to realize $\lambda_n$-arbitrary different radiation patterns, including patterns optimized for multiple frequencies. The most preferred approach applies a sequence of different Hutchinson operators to different geometric subsets, thereby achieving patterns which are not only arbitrary in terms of wavelength/frequency, but also permit variable radiation patterns and variable polarization other desirable criteria. In addition to the use of variable scaling, geometric patterns, and the like, multiple structures may be placed within the same spatial footprint to permit reception over more bands. A dynamic reconfigurable antenna array is provided according to an alternative embodiment, enabling a single device to be simultaneously tuned to different or multiple frequencies or other response criteria. The antenna array may be made directional in its radiation (or reception) pattern either by changing the configuration of the array, changing the feed points in the array, or electrically steering the pattern using standard beam formatting techniques on multiple taps. Once a particular antenna architecture is defined, electrical or micro-mechanical switches are placed at key points of the structure enabling the pattern to be changed dynamically. Alternatively, a reconfigurable multi-dimensional array may be used having an active area optimized to maximize reception for a desired frequency and/or directionality.

12 Claims, 22 Drawing Sheets

Self-similar structure (Fractal)

A-subset, e.g. ▲
Hutchinson operator W
Similarity transform
(rotation, translation, scale)

$$W[A] = w_1[A] \cup w_2[A] \cup \cdots \cup w_N[A]$$

$$\begin{pmatrix} x' \\ y' \end{pmatrix} = \begin{pmatrix} r\cos\phi & -r\cos\phi \\ r\sin\phi & r\cos\phi \end{pmatrix} \begin{pmatrix} x \\ y \end{pmatrix} + \begin{pmatrix} x_0 \\ y_0 \end{pmatrix}$$

$$A_1 = W[A]$$

$$A_2 = W[W[A]]$$

$$\vdots$$

$$A_n = W[A_{n-1}]$$

Iterate the *same* Hutchinson operator
Multi-freq.: $\lambda_n = r^n \lambda_0$
Same behavior at each freq.

FIGURE 1A

Self-affine structure

Hutchinson operator W
Affine linear transform
(rot., trans., scale, skew, refl.)

$$W[A] = w_1[A] \cup w_2[A] \cup \cdots \cup w_N[A]$$

$$\begin{pmatrix} x' \\ y' \end{pmatrix} = \begin{pmatrix} r\cos\phi & -s\cos\psi \\ r\sin\phi & s\cos\psi \end{pmatrix} \begin{pmatrix} x \\ y \end{pmatrix} + \begin{pmatrix} x_0 \\ y_0 \end{pmatrix}$$

$$A_1 = W[A]$$

$$A_2 = W[W[A]]$$

$$\vdots$$

$$A_n = W[A_{n-1}]$$

Iterate the *same* Hutchinson operator
Multi-freq.: $\lambda_n = s^{n/2} r^{n/2} \lambda_0$
Different radiation patterns

FIGURE 1B

Hausdorff structure

A-subset, e.g. ▲
Hutchinson operator W
Affine linear transform $$W[A] = w_1[A] \cup w_2[A] \cup \cdots \cup w_N[A]$$

$$\begin{pmatrix} x' \\ y' \end{pmatrix} = \begin{pmatrix} r\cos\phi & -s\cos\psi \\ r\sin\phi & s\cos\psi \end{pmatrix} \begin{pmatrix} x \\ y \end{pmatrix} + \begin{pmatrix} x_0 \\ y_0 \end{pmatrix}$$

$$A_1 = W_1[A]$$

$$A_2 = W_2[W_1[A]]$$

$$\vdots$$

$$A_n = W_n[W_{n-1}[\cdots W_1[A]]]$$

Sequence of *different*
Hutchinson operators
Multi-freq.: $\lambda_n$-arbitrary
Different radiation patterns

FIGURE 1C $A^m$-subset, e.g. ▲ ■ ◠

Hutchinson operator W

Affine linear transform $$W\left[A^1 \cdots A^m\right] = w_1\left[A^1 \cdots A^m\right] \cup w_2\left[A^1 \cdots A^m\right] \cup \cdots \cup w_N\left[A^1 \cdots A^m\right]$$

$$\begin{pmatrix} x' \\ y' \end{pmatrix} = \begin{pmatrix} r\cos\phi & -s\cos\psi \\ r\sin\phi & s\cos\psi \end{pmatrix} \begin{pmatrix} x \\ y \end{pmatrix} + \begin{pmatrix} x_0 \\ y_0 \end{pmatrix}$$

$$A^1{}_1 = W_1\left[A^1 \cdots A^m\right]$$

$$A^1{}_2 = W_2\left[W_1\left[A^1 \cdots A^m\right]\right]$$

$$\vdots$$

$$A^1{}_n = W_n\left[W_{n-1}\left[\cdots W_1\left[A^1 \cdots A^m\right]\right]\right]$$

Sequence of *different* Hutchinson operators on *different* subsets

Multi-freq.: $\lambda_n$-arbitrary

Radiation patterns: variable

Polarization: variable

FIGURE 2

Impedances at evaluated frequencies

| Freq. MHz | Z | Freq. MHz | Z |
|---|---|---|---|
| 875 | 52.66 – 43.51j | 1375 | 64.64 – 68.61 |
| 900 | 66.46 + 10.65j | 1400 | 58.04 – 12.90j |
| 925 | 86.18 + 68.88j | 1425 | 54.07 + 48.08j |

```
evals:  160
gen: 20 max: 0.00037929641878518128 dev: 0.0030722762472613009 eval time: 541.18
229300092753
[1.1447440201433163, 1.1000000000000001, 1.0, 1.0, 3, 4, 0.085716473822167377]
NUMBER OF POINTS      (MAX       1000) :         81

Z: [(52.659-43.514j), (66.46+10.654j), (86.18+68.884j)]
Z: [(64.641-68.605j), (58.037-12.9j), (54.071+48.075j)]
[1.1447440201433163, 1.1000000000000001, 1.0, 1.0, 3, 4, 0.085716473822167377]
0.000379296418785
```

Best score = 3.79296e-4

FIGURE 6

ANTENNA STRUCTURES BASED UPON A GENERALIZED HAUSDORFF DESIGN APPROACH

REFERENCE TO RELATED APPLICATION

This application claims priority from U.S. Provisional Patent Application Serial No. 60/311,267, filed Aug. 9, 2001, the entire content of which is incorporated herein by reference.

FIELD OF THE INVENTION

This invention relates generally to radio-frequency (RF) antennas, and, in particular, to convoluted and folded antenna patterns based upon generalized Hausdorff structures.

BACKGROUND OF THE INVENTION

The design of RF antennas can be exceedingly complex and mathematically and empirically intense due to the wide range of tradeoffs involving frequency response, sensitivity, directionality, polarizations, and so forth. Conventional antennas, such as open loops and parallel element arrays are limited in terms of applicability, such that, quite often, a particular geometry is relegated to a dedicated frequency band or direction.

It has been found that so-called fractal antennas offer certain advantages over conventional designs, including smaller size and desirable performance at multiple frequencies. In addition to greater frequency independence, such antennas afford enhanced radiation, since the often large number of sharp edges, corners, and discontinuities each act as points of electrical propagation or reception.

The term 'fractal' was coined by Benoit Mandelbrot in the mid-70s to describe a certain class of objects characterized in being self-similar and including multiple copies of the same shape but at different sizes or scales. Fractal patterns and multi-fractal patterns have by now been widely studied, and further information on fractal designs may be found in *Frontiers in Electromagnetics*, IEEE Press Series on Microwave Technology and RF, 2000, incorporated herein by reference.

Fractal antennae were first used to design multi-frequency arrays. The Sierpinski gasket antenna, which resembles a triangle packed with differently sized triangles of the same general orientation, was the first practical antenna to maintain performance at several (5) bands. Other fractal geometries used in antenna design include the Sierpinski carpet, which may be viewed as a square-within-a-square version of the Sierpinski gasket, as well as the snowflake or Koch curve, which has also been used in monopole form.

In designing an antenna based upon a folded or convoluted fractal-type geometry, the resonance frequencies may be a function of multiple parameters, including the shape of the structuring or replicated element, the size of the smallest element, and the number of scaling factors used simultaneously in the pattern. Despite the improved performance of antennas based upon fractal geometries, existing designs exhibit certain disadvantages. In particular, though self-similar, conventional fractals are based upon a heterogeneous reproduction of structuring elements limited to transformations in terms of rotation, translation, and scale, fractal structures utilize a subset of a Hutchinson operator W, wherein a regular shape, such as a triangle or square is iterated such that the same behavior may be obtained, albeit at multiple frequencies. Increased degrees of freedom are required to design structures with appropriate gain, beam patterns, polarization response, and other desirable characteristics.

SUMMARY OF THE INVENTION

This invention improves upon the existing art by providing an approach to antenna design that optimizes gain, beam pattern, polarization response, or other qualities, including desirable characteristics which might otherwise be in conflict. Broadly, the invention endeavors to generalize self-replicating antenna patterns through the use of additional transformations and candidate geometric shapes. One improvement over the self-similar fractal structure is the self-affine structure, which, in addition to fractal-type operators permits transformations such as skewing, reflection (i.e., flipping). In the preferred embodiment, however, Hausdorff structures are used, including multiple instances of variable patterns to enhance variability and design freedom.

More particularly, whereas the self-affine structure utilizes a single Hutchinson operator, according to one use of the Hausdorff structure consistent with this invention, different Hutchinson operators are utilized to realize $\gamma_n$-arbitrary different radiation patterns, including patterns optimized for multiple frequencies. Although a more limited Hausdorff structure may be based upon a single type of geometry (i.e., a square, triangle, or arc), the most preferred more generalized approach according to the invention applies a sequence of different Hutchinson operators to different geometric subsets, thereby achieving patterns which are not only arbitrary in terms of wavelength/frequency, but also permit variable radiation patterns and variable polarization other desirable criteria inherit in the approach. In addition to the use of variable scaling, geometric patterns, and the like, multiple structures may be placed within the same spatial footprint to permit reception over more bands.

According to yet a further aspect of the invention, a dynamic reconfigurable antenna array is provided, enabling a single device to be simultaneously tuned to different or multiple frequencies or other response criteria. The antenna array may be made directional in its radiation (or reception) pattern either by changing the configuration of the array, changing the feed points in the array, or electrically steering the pattern using standard beam formatting techniques on multiple taps. Although the resultant geometry is preferably that of a generalized Hausdorff structure, it will be appreciated by those of skill that this aspect of the invention is applicable to any type of antenna geometry, including conventional, fractal, self-affine, and so forth.

In a reconfigurable implementation, once a particular antenna architecture is defined, switches are placed at key points of the structure enabling the pattern to be changed dynamically. Such switching may be carried out in real time in accordance with transmissions/reception characteristics, though a more preferable approach is to change the pattern and verify the simulations in accordance with the switched elements. The switches may be implemented with any appropriate technology, including electrical switches such as MOSFETs, though, in the preferred embodiment, MEMS mechanical switches are used to ensure that the resulting pattern includes continuous metalization for the least amount of leakage and unwanted artifacts.

As an alternative to a fixed pattern with switches used to swap elements or change feed points, a reconfigurable multi-dimensional array may be used having an active area optimized to maximize reception for a desired frequency and/or direction. This aspect of the invention may exploit flat-panel technology, wherein, for example, a transparent conductor array 'face' may be mapped to an addressable interconnect back plane to achieve a desired level of reconfigurability.

BRIEF DESCRIPTION OF THE DRAWINGS

FIG. 1A provides a set of equations associated with the generation of a self-similar antenna structure (fractal);

FIG. 1B provides a set of equations associated with the generation of a self-affine structure applicable to antenna design;

FIG. 1C provides a set of equations associated with the generation of a Hausdorff structure applicable to antenna design;

FIG. 2 provides a set of equations associated with the generation of a generalized Hausdorff structure, wherein a sequence of different Hutchinson operators are applied to different geometrical subsets;

FIG. 6 is a table which lists impedances evaluated at six different frequencies in conjunction with an antenna structure generated according to the invention;

DETAILED DESCRIPTION OF THE INVENTION

Broadly according to this invention, increased degrees of freedom are provided to design antenna structures possessing appropriate gain, beam pattern(s), polarization response (s), and so forth. Toward that end, the invention endeavors to generalize self-respecting patterns through the use of multiple structural transformations and candidate shapes.

One improvement over the self-similar fractal structure is the self-affine structure, which, in addition to fractal-type operators permits skewing, reflection (i.e., flipping). As shown in FIG. 1B, whereas the self-similar fractal structures are limited to a coefficient r, self-affine structures permit the use of r and s, thereby facilitating stretching and other more complex manipulations.

In the preferred embodiment of this invention, however, Hausdorff structures are used, and, in fact, multiple instances of the structure are deployed to enhance variability and design freedom. Whereas the self-affine structure utilizes a single Hutchinson operator W, according to one use of the Hausdorff structure consistent with this invention, different Hutchinson operator ($W_1W_2 \ldots W_n$) are utilized to realize $\lambda_n$-arbitrary different radiation patterns at multiple frequencies.

Furthermore, whereas a more limited Hausdorff structure may be based upon a single type of geometry (i.e., a triangle, as shown in FIG. 1C), the most preferred more generalized approach according to the invention permits a sequence of different Hutchinson operators on different subsets thereby realizing patterns which are not only arbitrary in terms of wavelengths/ frequency, but also permit variable radiation patterns and variable polarization criteria inherit in the approach.

Basic equations for this generalized Hausdorff structure are presented in FIG. 2, along with a few potential Hutchinson operators such as triangle, square, and arc, with the understanding that the approach is not limited in this regard, and that more complex geometric shapes may be used as inputs.

Figure 3:
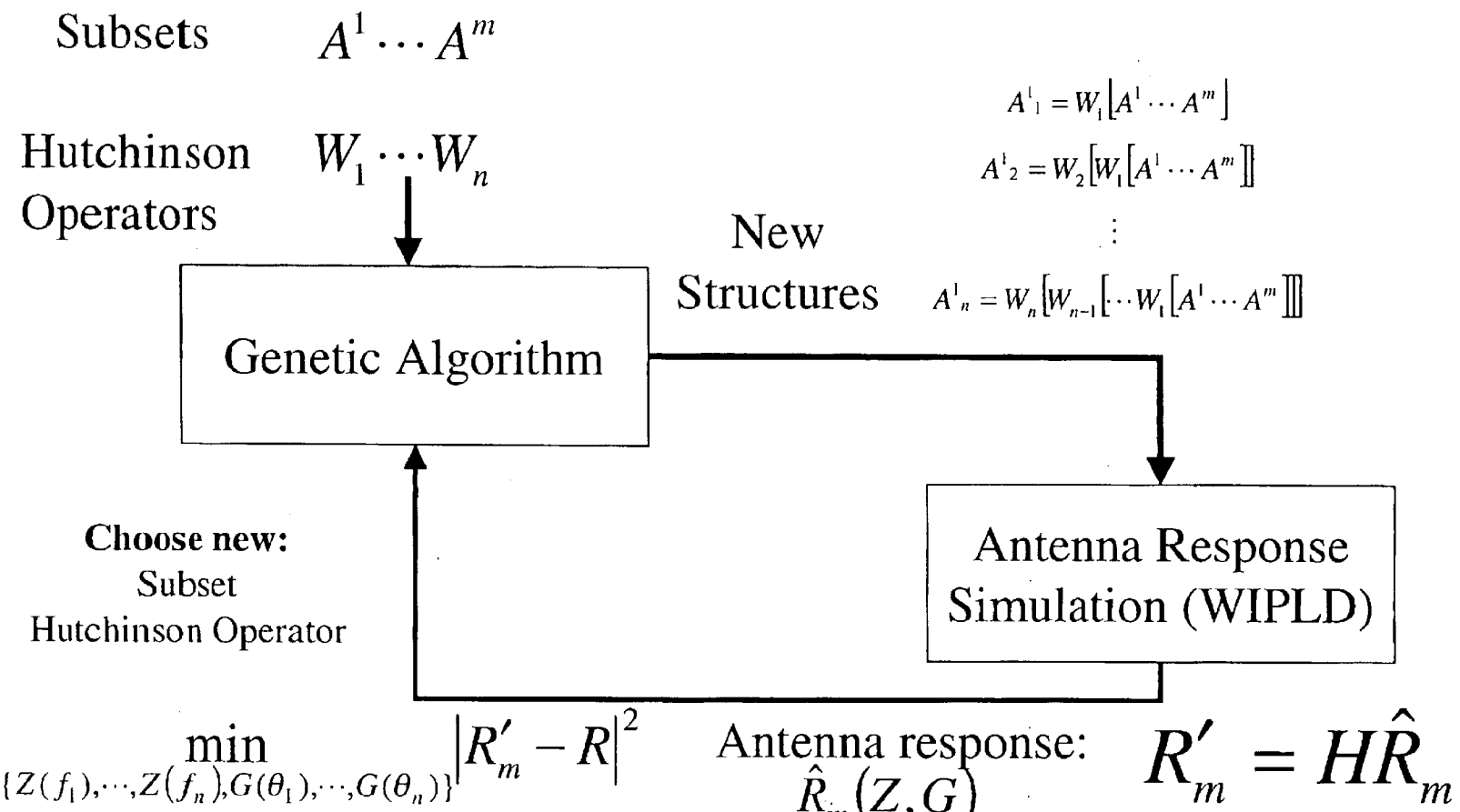
FIG. 3 is a diagram which shows the way in which operators and geometrical subsets may be fed to a genetic algorithm and simulated to achieve a desired antenna structure according to the invention.
Figure 4:
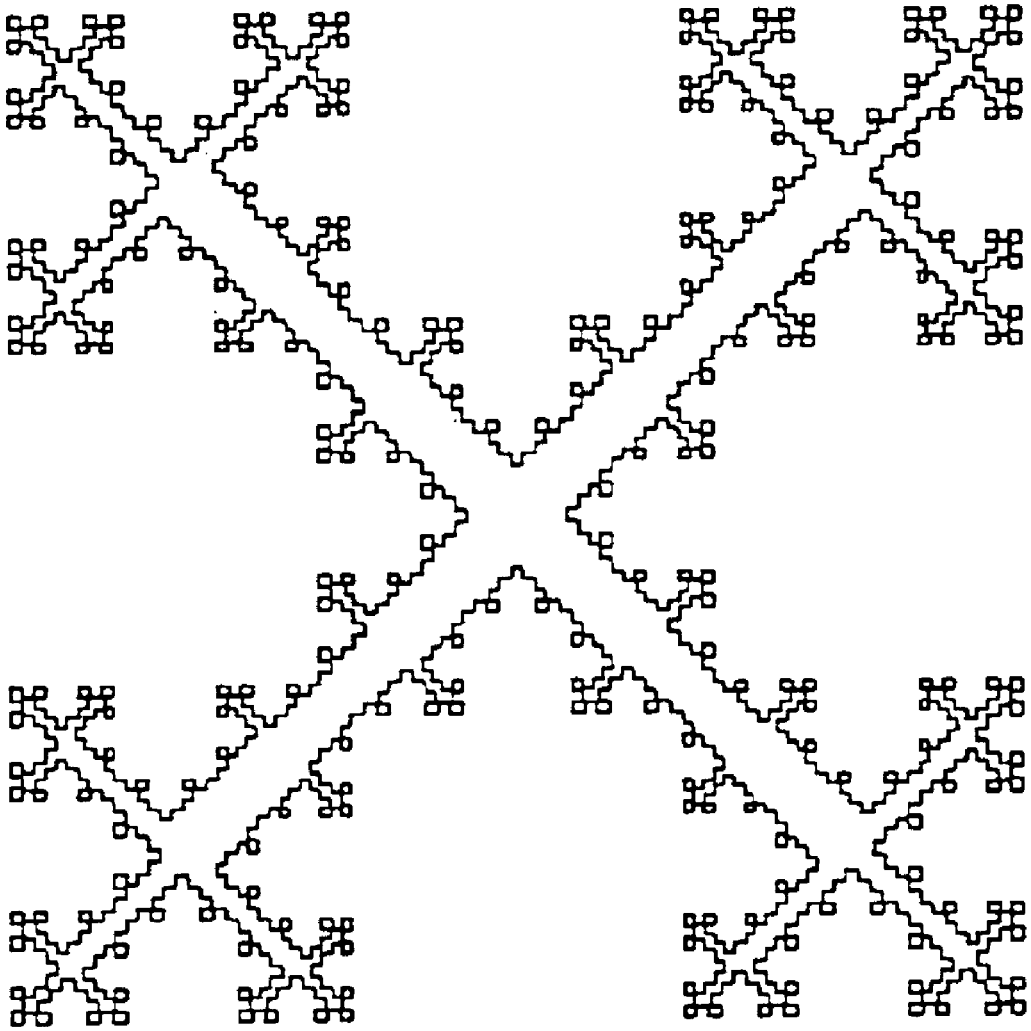
FIG. 4 is an example using a square iteration of a square loop at a fixed scale chosen to obtain the lowest frequency.

The general design approach according to the invention is depicted in FIG. 3. Broadly, a group of subsets and Hutchinson operators are entered into a genetic algorithm and iterated through an antenna response simulation with the goal being to settle upon a desired response. If the response is unacceptable or otherwise inadequate, new operators may be chosen along with appropriate boundary values, with continued iterations until an acceptable result is achieved. FIG. 4 is a drawing of the structure obtained according to the invention resulting from an initialization based upon a square loop and a square iteration at a fixed scale, with the scale being chosen to obtain the lowest frequency.

Figure 5C:
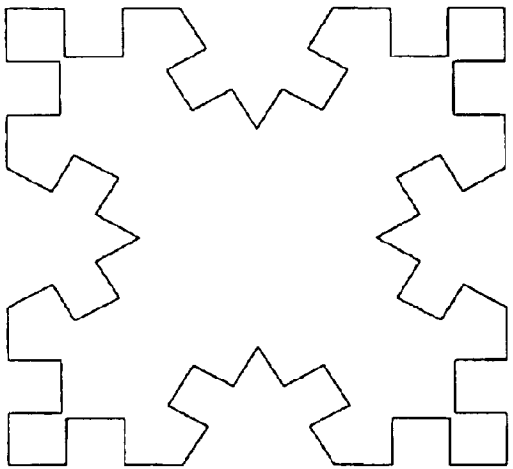
FIG. 5C shows the result of a second iteration using a Hausdorff dimension of D=1.39.
Figure 5B:
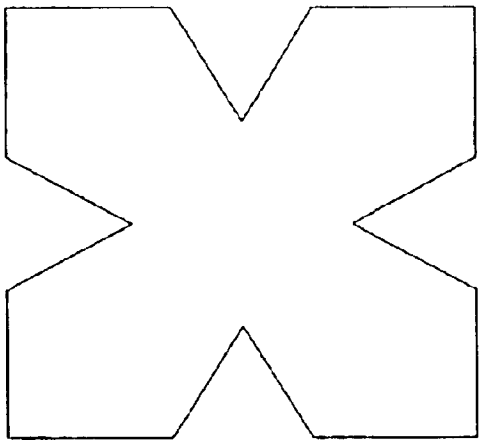
FIG. 5B shows the result of a first iteration using a Hausdorff dimension of D=1.32.
Figure 5A:
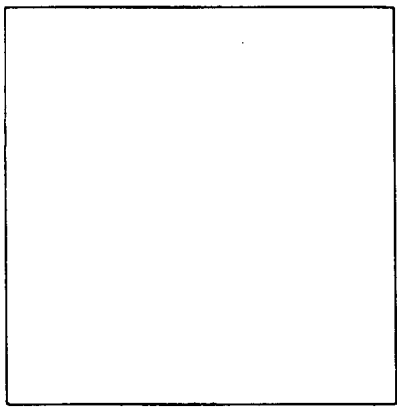
FIG. 5A illustrates the design of a Hausdorff antenna pattern according to the invention beginning with a square axiom.

More beneficial results may be obtained, however, utilizing iterations wherein the scale and structuring element are varied to meet multiple performance criteria. A design of a particular Hausdorff antenna using a generalized approach according to the invention is shown in FIG. 5, wherein an axiom in the form of a square (FIG. 5A) is iterated once into a modified X-shaped pattern (FIG. 5B), using Hausdorff dimension D=1.32 then again into a square-ish snowflake pattern FIG. 5C) through a second iteration with D=1.39. In this design example, the wire size is equal to 0.3 mm, the desired impedance response being 50Ω @ 900 MHz and 1400 MHz. Such a response would be desirable, for example, in current digital cellular telephone applications.

Figure 7:
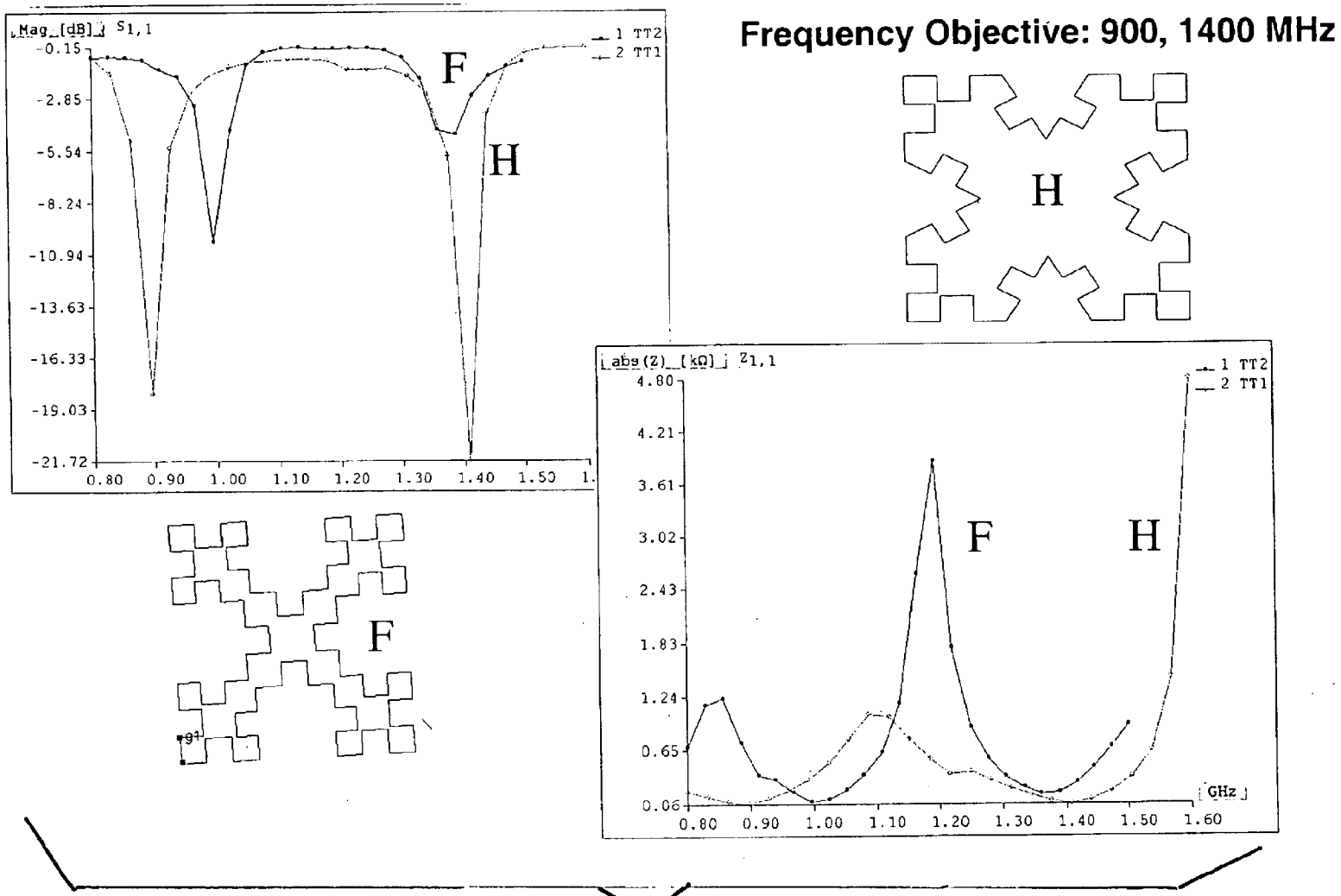
FIG. 7 is a drawing which compares the generalized structure generated in FIG. 5 with a fractal structure in terms of a particular frequency objective.

Using a commercially available simulation program (WIPL-D), 250 competing structures were evaluated at each iteration, with a maximum of 20 iterations in total. Performance was observed at bands around the 900 and 1400 MHz targets, namely, 875/900/925 and 1375/1400/1425 MHz. The results are given in FIG. 6. For the sake of comparison, two different antenna designs were generated, one based on a conventional fractal approach ('F' in FIG. 7) to a generalized Hausdorff method according to the invention ('H' in FIG. 7).

As can be seen, the definition of the response at the desired frequencies is much sharper for the generalized Hausdorff approach using variable structuring elements. It should also be noted that although two particular patterns and sets of curves are depicted in conjunction with this design example, use of the same data or slightly modified criteria or constraints could result in even more desirable results.

Figure 8B:
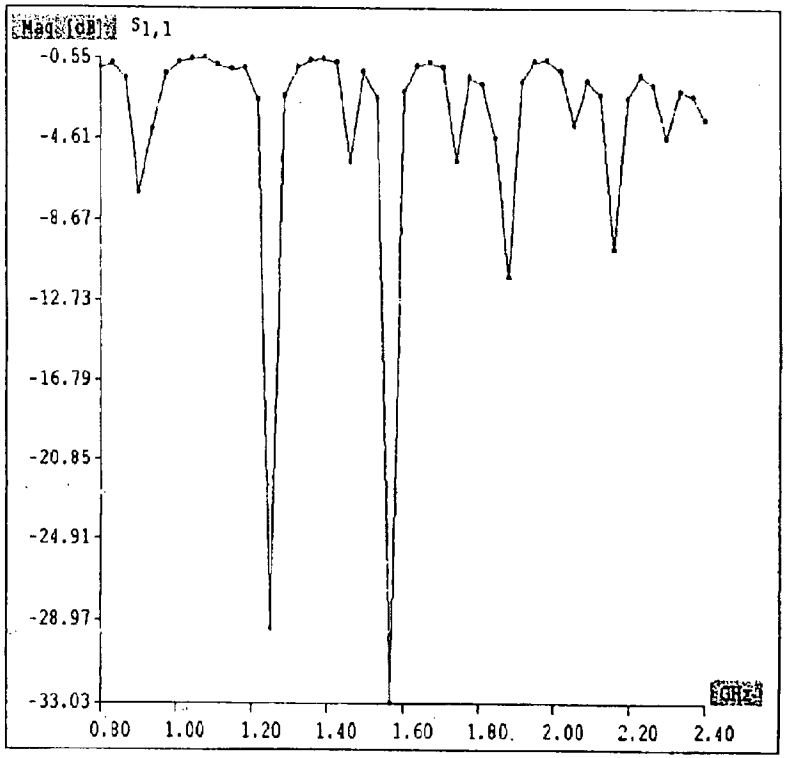
FIG. 8B is a plot of the response characteristics for the structure of FIG. 8A.
Figure 8A:
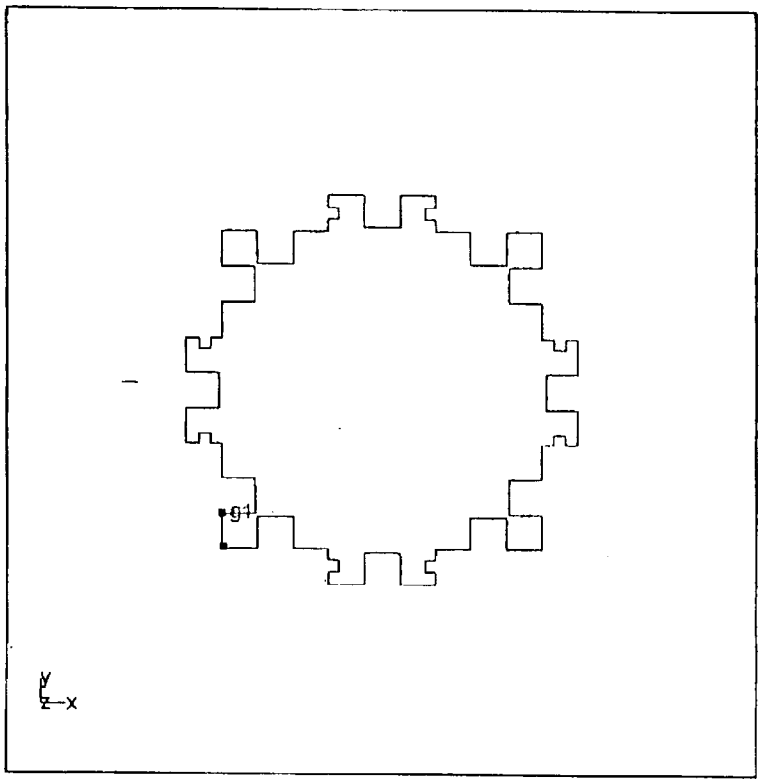
FIG. 8A is a drawing of an antenna structure generated in accordance with the invention to achieve multiple frequency response characteristics.
Figure 9B:
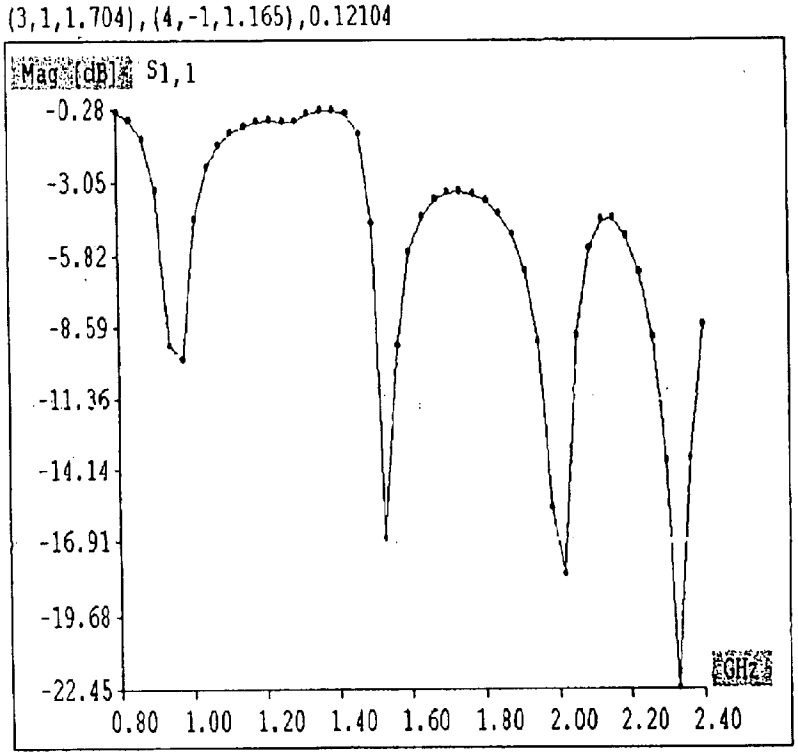
FIG. 9B is a plot of the response characteristics for the structure of FIG. 9A.
Figure 9A:
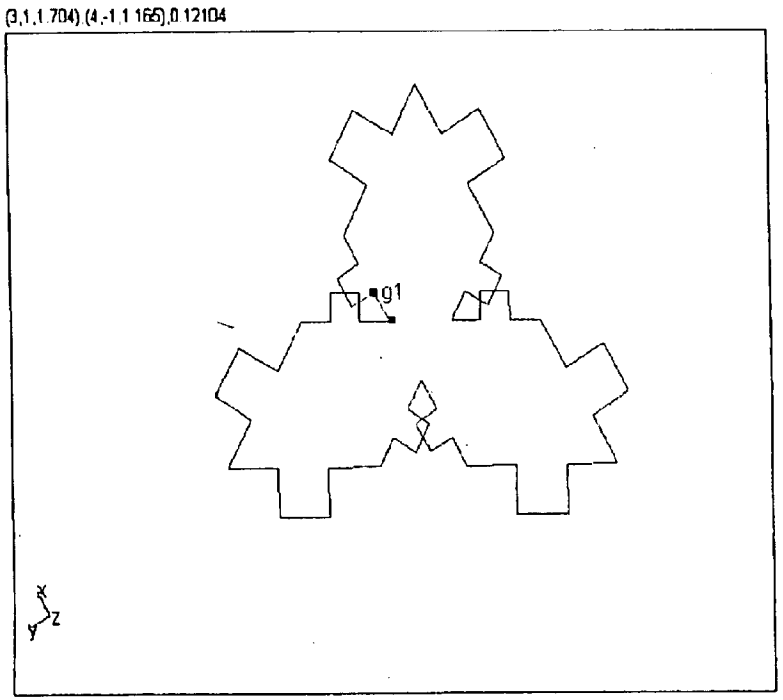
FIG. 9A is a drawing of an antenna structure generated in accordance with the invention to achieve multiple frequency response characteristics.

FIGS. 8 and 9 show the results obtained for a three-band example, with the goal being a desired response at 900 MHz (i.e., for cell phones); 1575 MHz (i.e., for GPS reception); and 2300 MHz (i.e., for digital radio). Again, the process was initiated with a square loop, and in this case both triangular and square iterations were allowed with a population with 250 and 20 iterations. The simulation was carried out with WIPL-D at f +/−25 MHz. FIG. 8A is a drawing of one structure obtained, with FIG. 8B illustrating the response obtained. FIG. 9A illustrates a different structure, with the response shown in FIG. 9B. Although in both cases some vestigial peaks are apparent, the response overall meets the desired criteria for each frequency, in a manner superior to basic fractal approaches.

Configurable Geometries

Based upon the computations performed in accordance with the above procedure, the indicated pattern may be etched or otherwise applied to a substrate with appropriate inner connections being made for a given application. It may be more advantageous, however, if a configurable pattern could be used to assume a variety of shapes, thereby lowering production costs. Toward that end, according to a different aspect of this invention, a dynamic reconfigurable antenna array is provided, enabling a single device to be simultaneously tuned to different or multiple frequencies or other response criteria. In addition, through port selection, a beam pattern may be steered through a selection of the feed points. Although the geometry assumed by such a pattern is preferably of the generalized Hausdorff structure so far described, it will be appreciated by those of skill that this aspect of the invention is applicable to any type of antenna geometry, including conventional, fractal, self-affine, and so forth.

Figure 10:
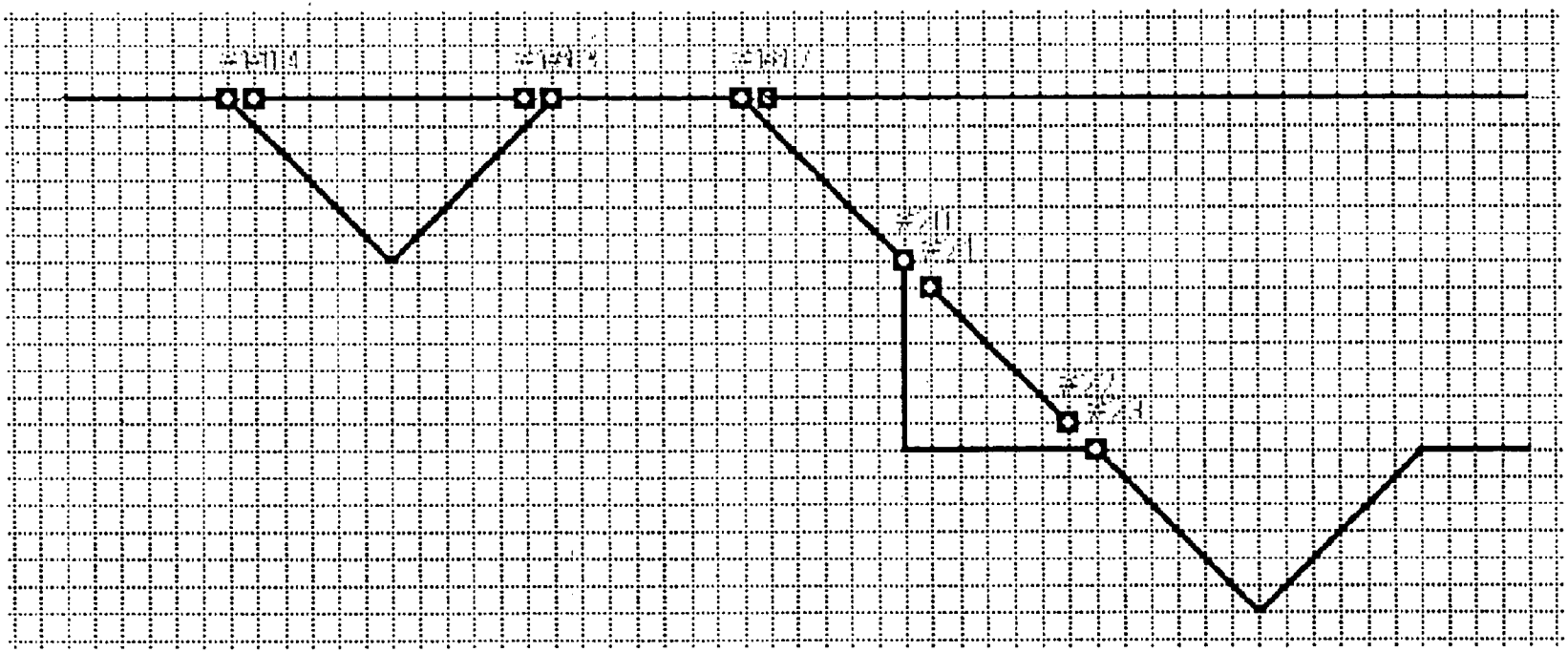
FIG. 10 is a drawing which shows the way in which switches may be used to configure an antenna geometry according to a different aspect of the invention.

According to a broad implementation, once a particular antenna architecture is defined, switches are placed at key points of the structure enabling the pattern to be changed dynamically, as shown in FIG. 10. This figure shows a portion of the pattern with switch points indicated in the array. Although this could be done in real time in accordance with transmissions/reception characteristics, a more preferable approach is to change the pattern and verify the simulations in accordance with the switched elements.

The switches may be implemented with any appropriate technology, including electrical switches such as MOSFETs, though, in the preferred embodiment, MEMS mechanical switches are used to ensure that the resulting pattern includes continuous metalization for the least amount of leakage and unwanted artifacts.

Figure 11:
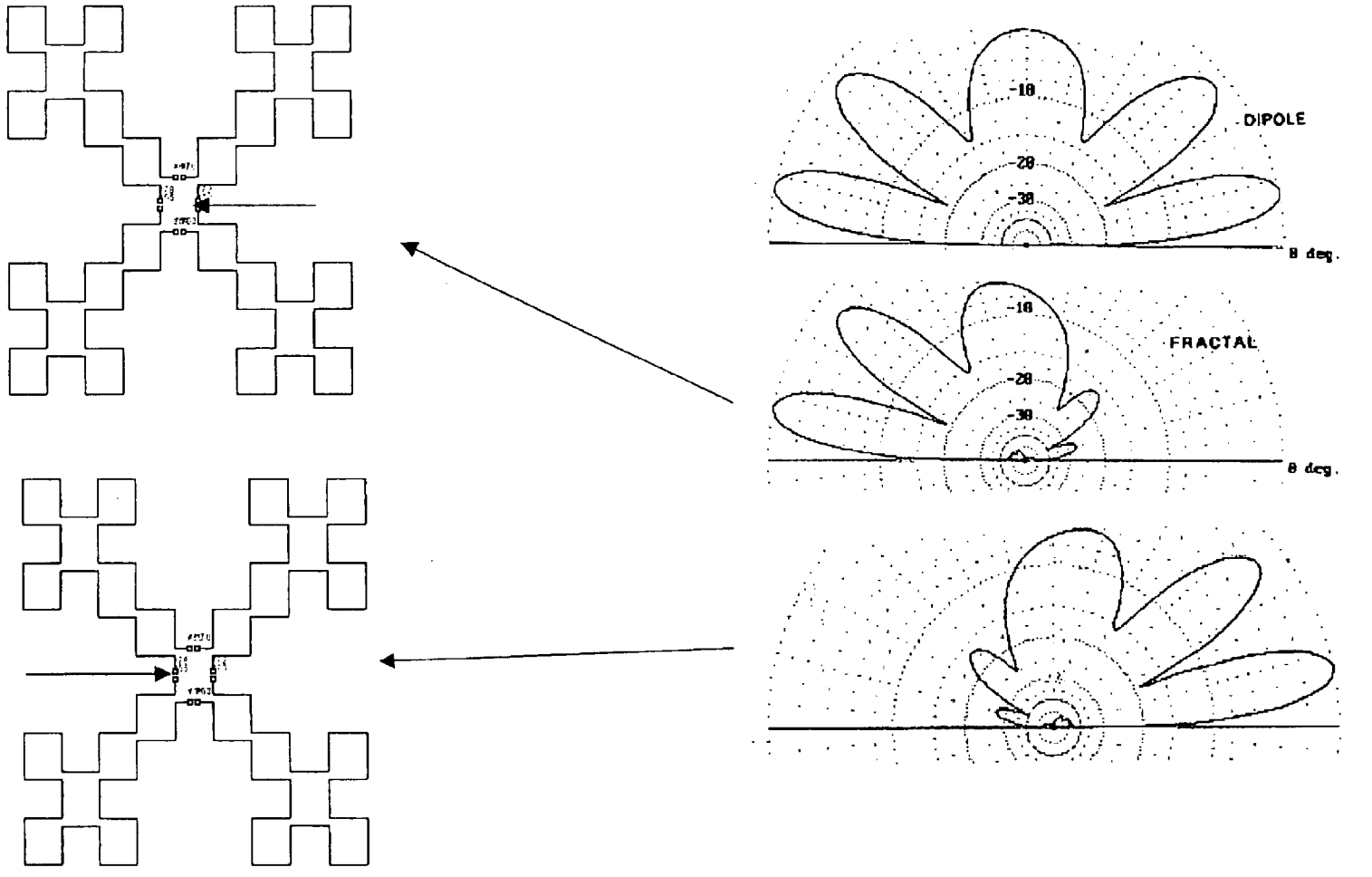
FIG. 11 is a drawing which shows the way in which different feed points may be used to change an antenna's directivity.

The antenna array may be made directional in its radiation (or reception) pattern either by changing the configuration of the array, changing the feed points in the array, or electrically steering the pattern using standard beam formatting techniques on multiple taps. FIG. 11, for example, shows how different feed points may be used to change directivity.

Figure 12:
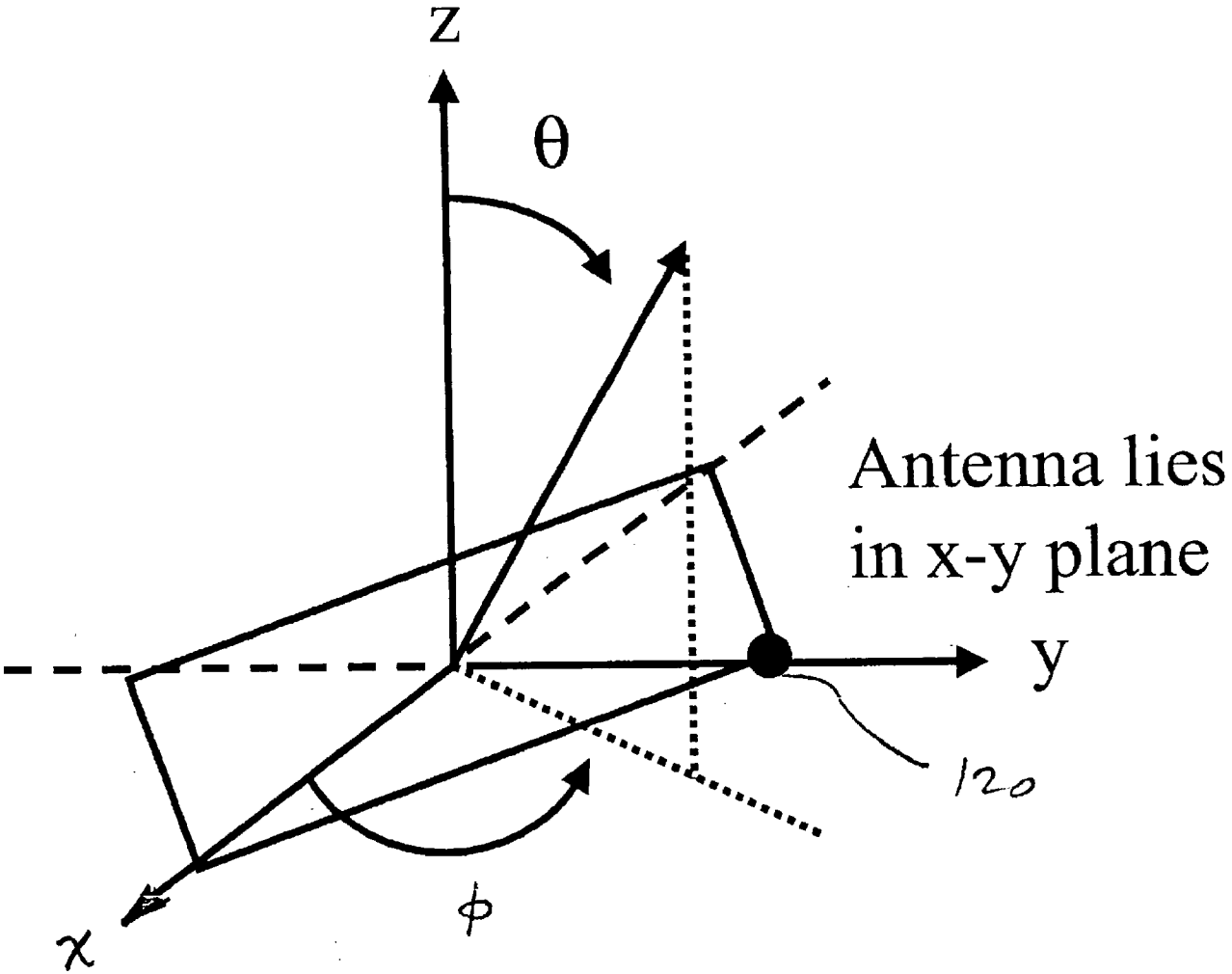
FIG. 12 is a diagram which shows the way in which a generator position may be oriented relative to an antenna plane.
Figure 13:
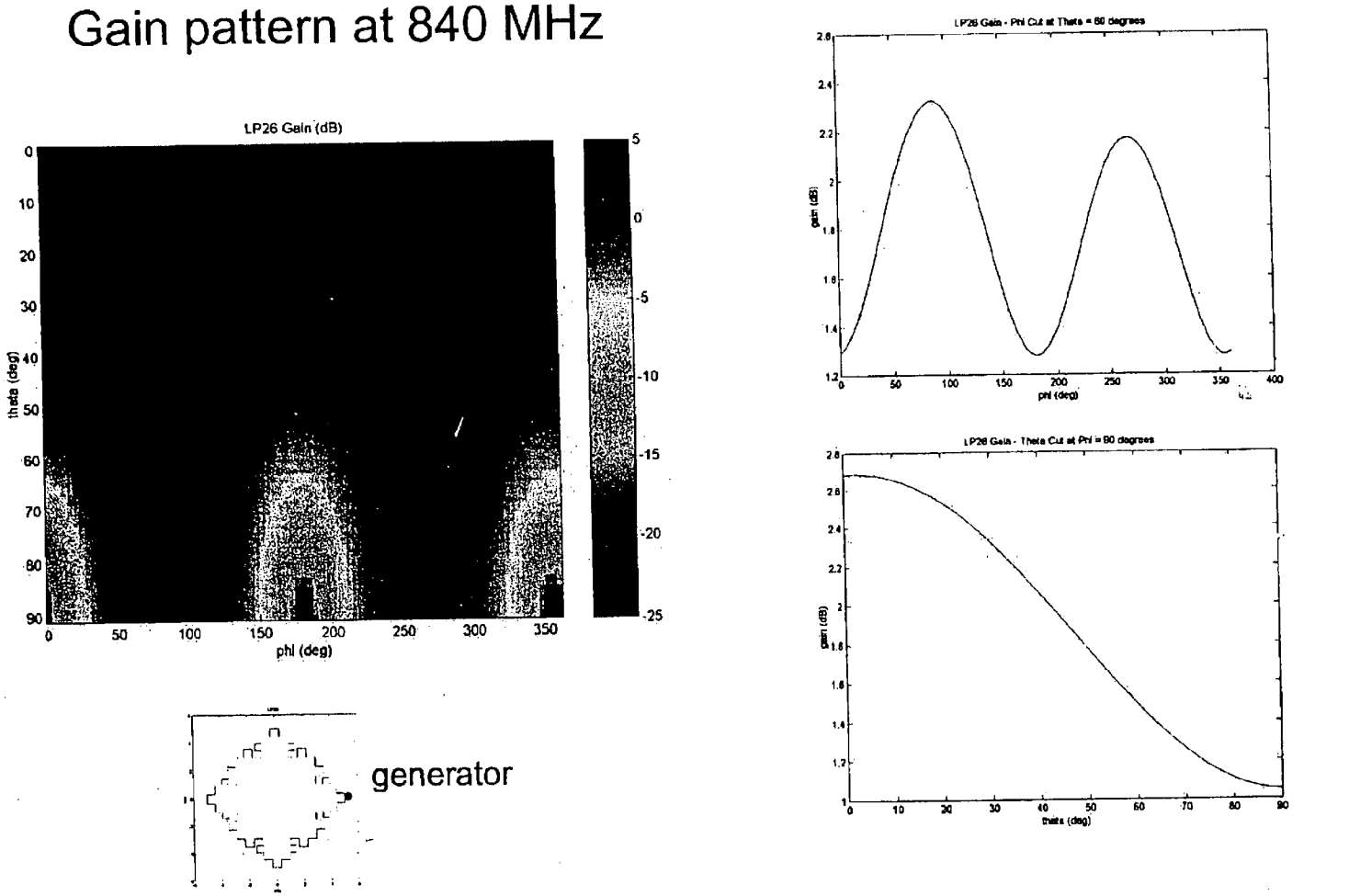
FIG. 13 is an example radiation gain pattern at 840 MHz.
Figure 14:
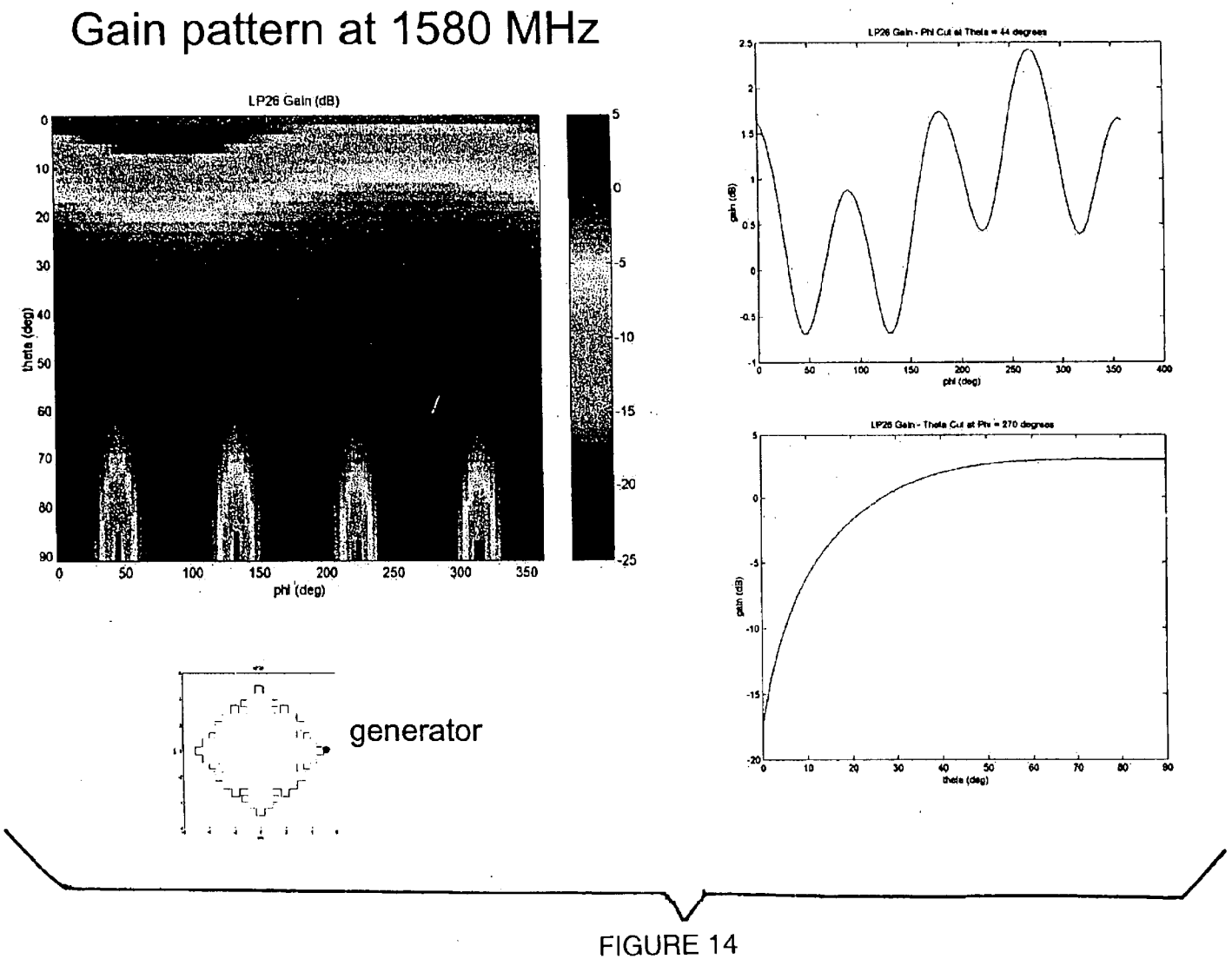
FIG. 14 is an example radiation gain pattern at 1580 MHz.
Figure 15:
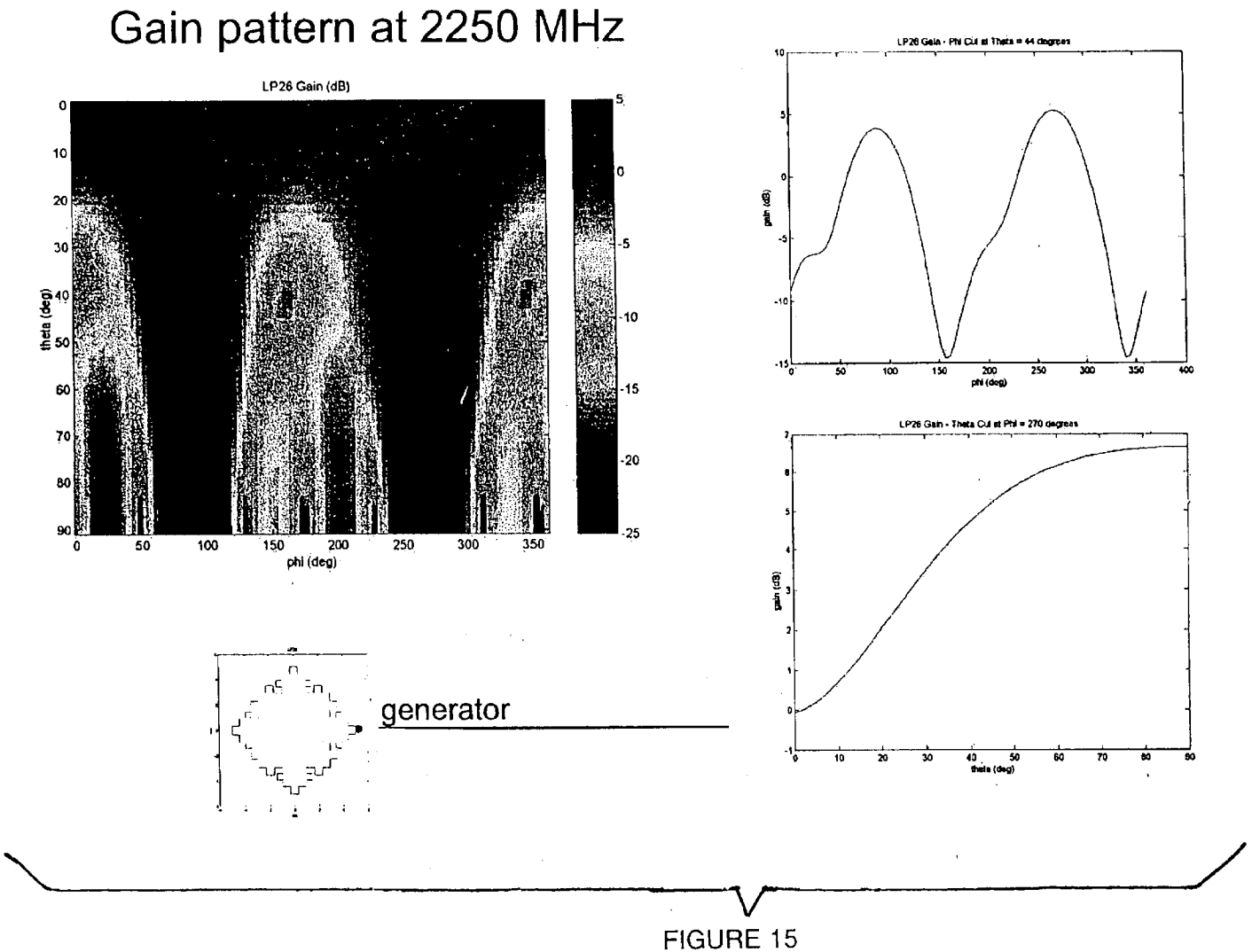
FIG. 15 is an example radiation gain pattern at 2250 MHz.

A particular radiation pattern may also be changed by altering the location of the generator as shown in FIG. 12. In this figure, the antenna lies in the x-y plane, with the location of the generator being given by the circle 120. Using this nomenclature, FIG. 13 is an example of a radiation gain pattern at 840 MHz, with the phi cut at theta being 60 degrees, and the theta cut at phi being 90 degrees. FIG. 14 is an example of a different radiation gain pattern at 1580 MHz, with a phi cut at theta of 44 degrees and a theta cut at phi of 270 degrees, and FIG. 15 is yet a different example of a radiation gain pattern at 2250 MHz, with the same angles referenced with respect to FIG. 14.

Figure 16:
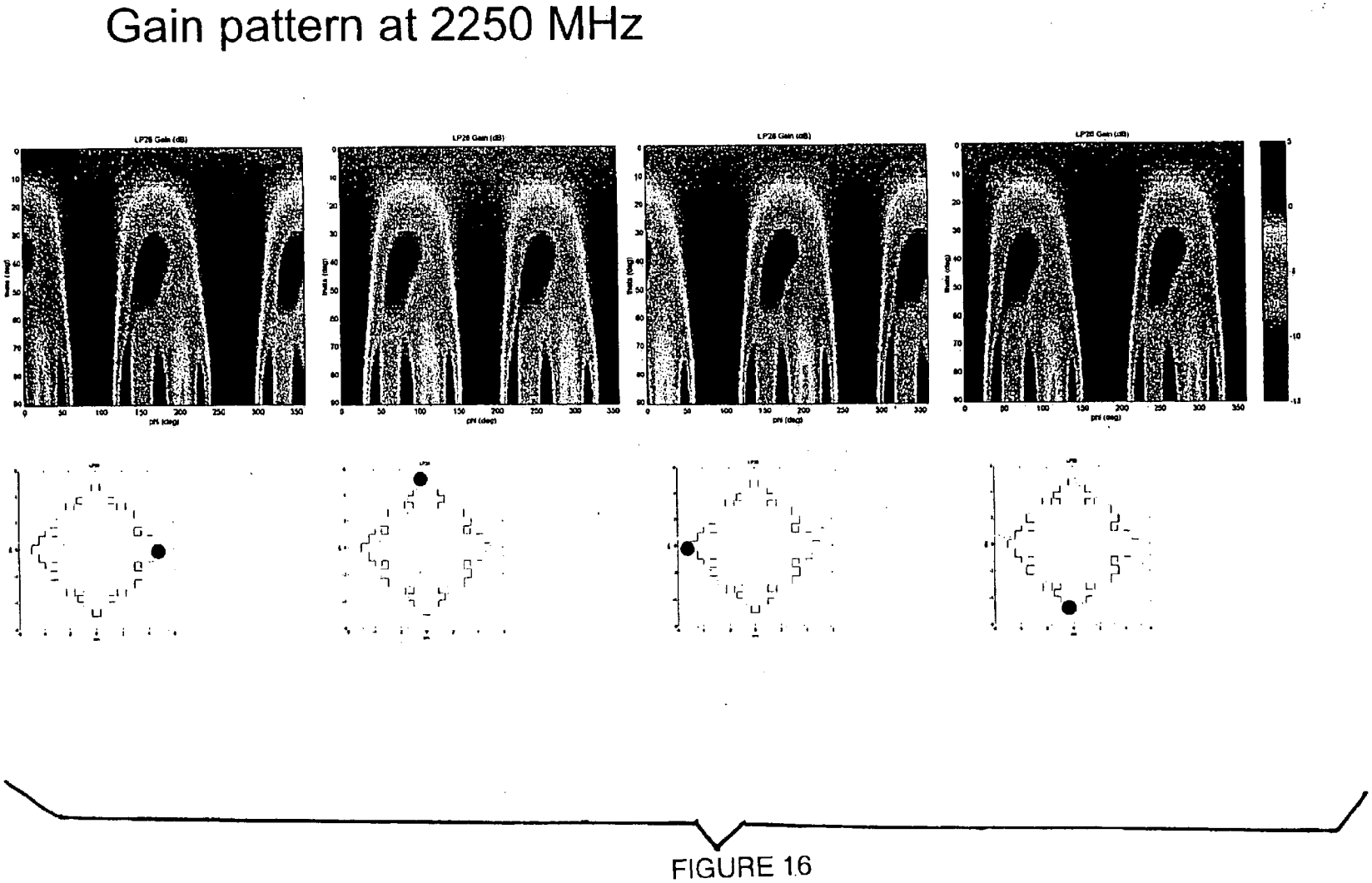
FIG. 16 is a steering radiation pattern at 250 MHz, with a generator being applied at different feed points.
Figure 17:
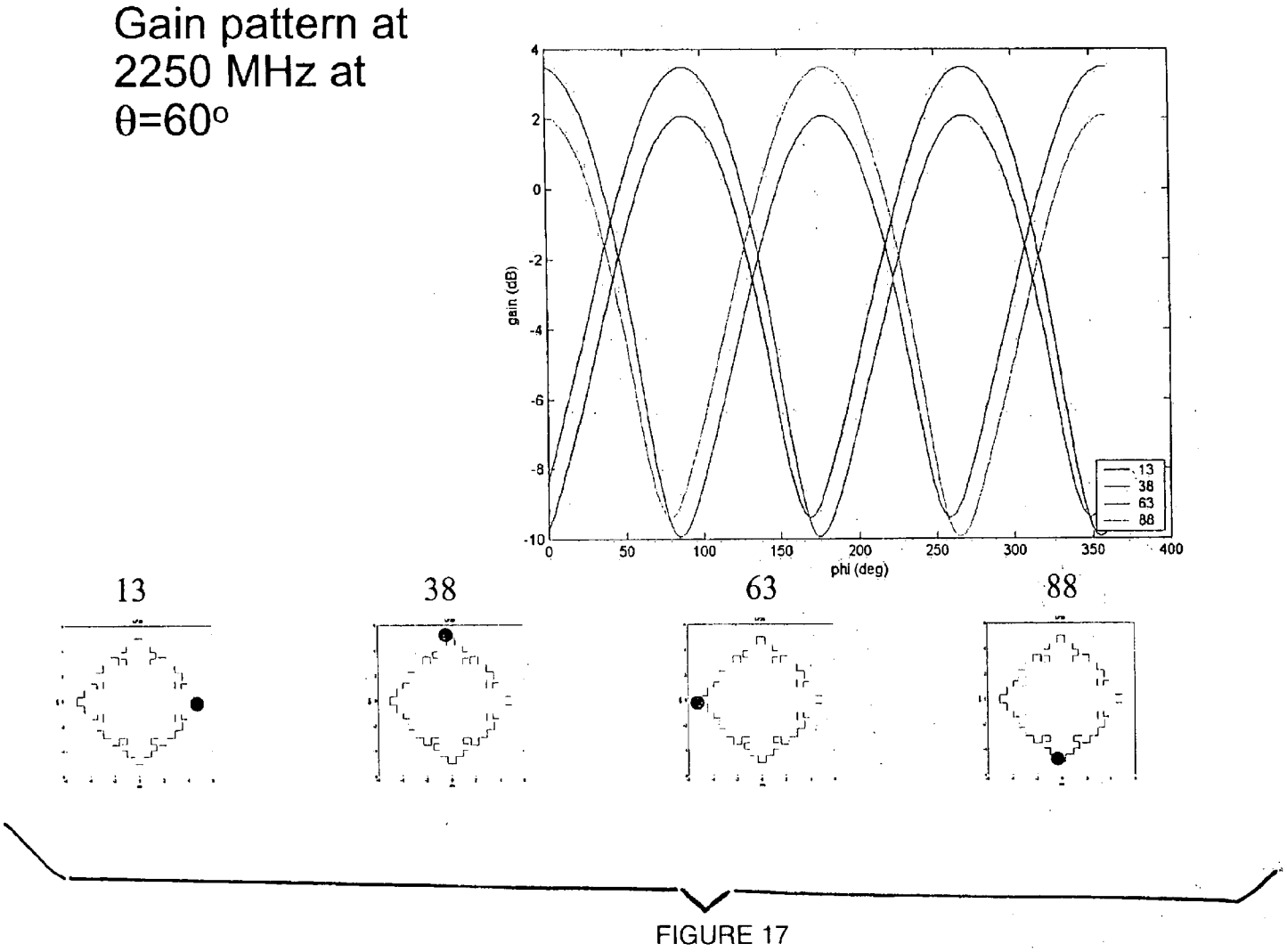
FIG. 17 plots gain vs. phi with theta equal to 60 degrees.

FIG. 16 is a drawing which shows the way in which a radiation pattern may be steered by moving the generator location, as indicated by the dot in the diagrams at the lower portion of the drawing. FIG. 17 is a drawing which shows gain as a function of phi, with theta equal to 60 degrees.

In addition to a component that allows for multiple antenna patterns with a single device, the use of multiple feeds and configurable structures may also allow the antenna to sustain a modest amount of damage while still being configured for reuse. Further advantage involves the ability to integrate other RF components with the MEMS structures or other electronic microcircuits including filters, and the like.

Embedded Geometries

Figure 18:
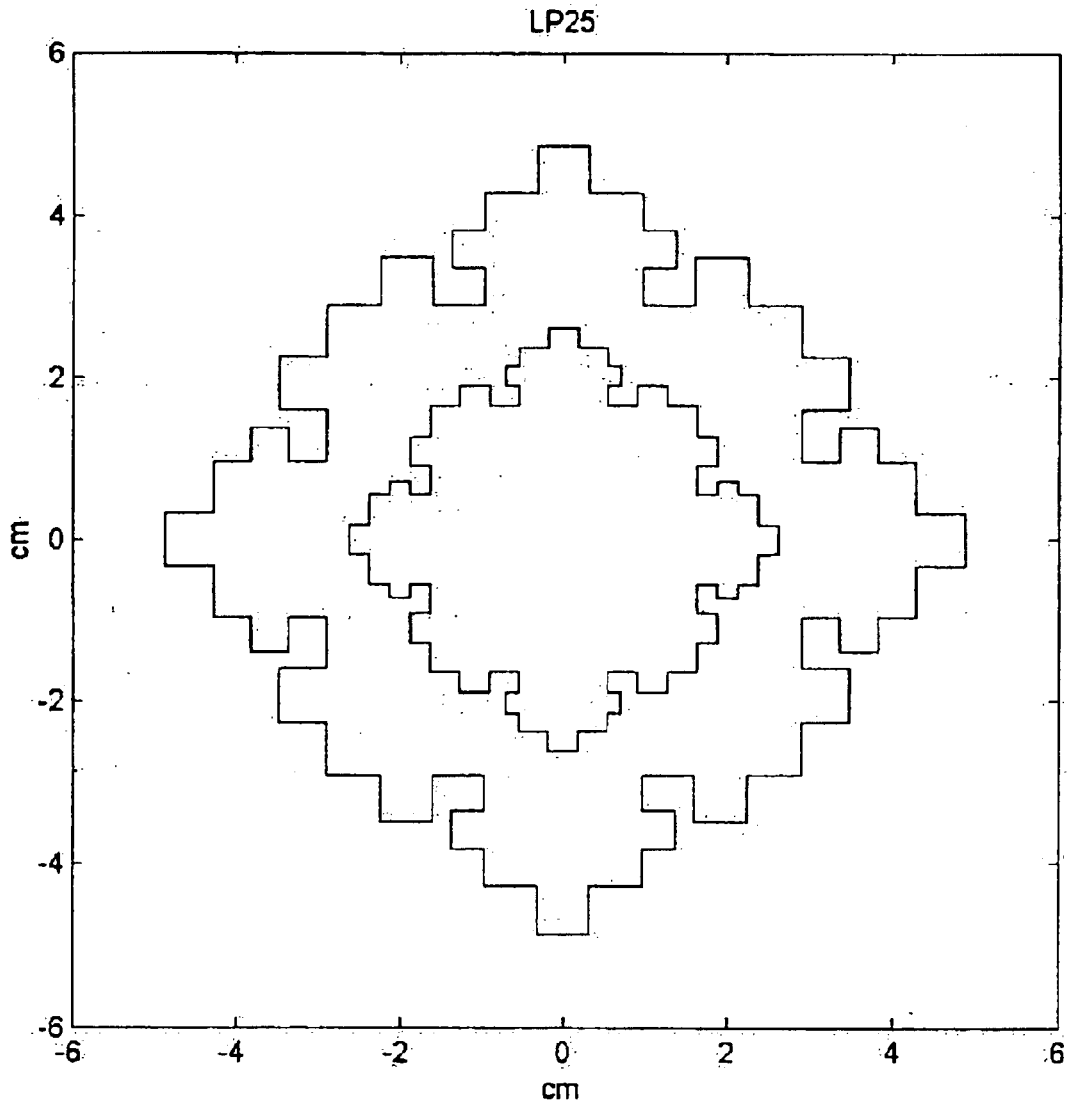
FIG. 18 shows the way in which multiple antenna structures may be placed within the same spatial footprint to permit reception over more frequency bands.
Figure 19:
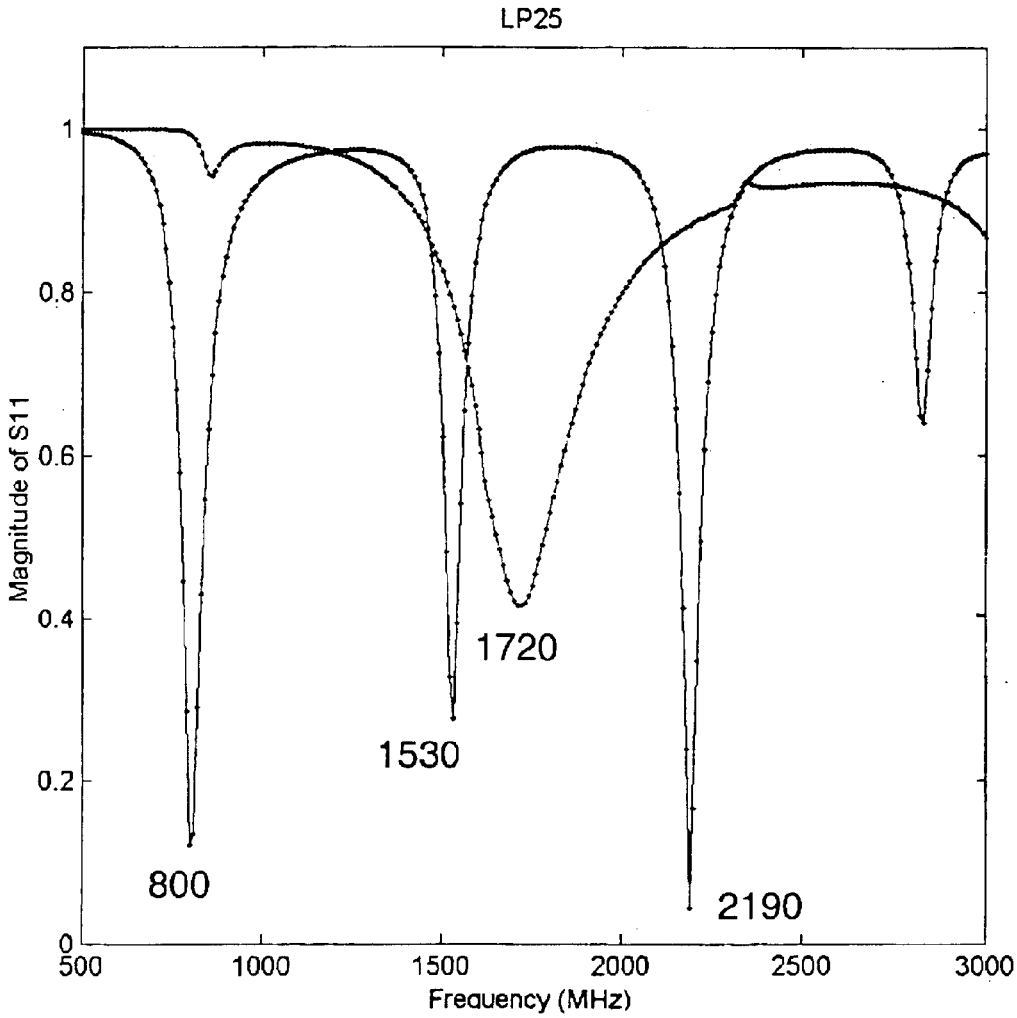
FIG. 19 is a plot showing frequency response for the embedded structure of FIG. 18.

In addition to the use of variable scaling, geometric patterns, and the like, according to the invention, multiple structures may be placed within the same spatial footprint to permit reception over more bands, as shown in FIG. 18. FIG. 19 is a drawing which provides response simulations performed with both structures present, illustrating how embedded structures may be used to accommodate additional frequency bands.

Figure 20B:
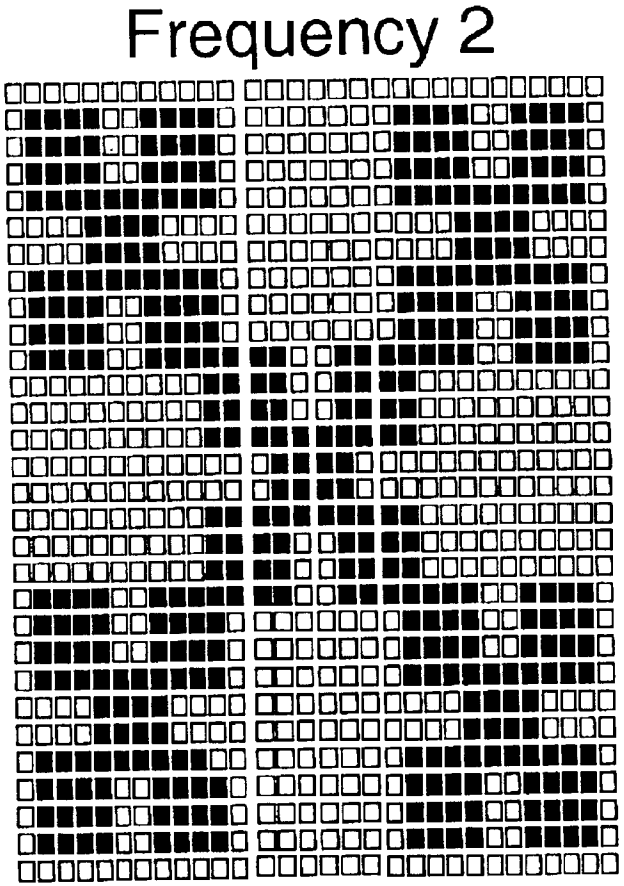
FIG. 20B illustrates a second frequency response for the reconfigurable array of FIG. 20A.
Figure 20A:
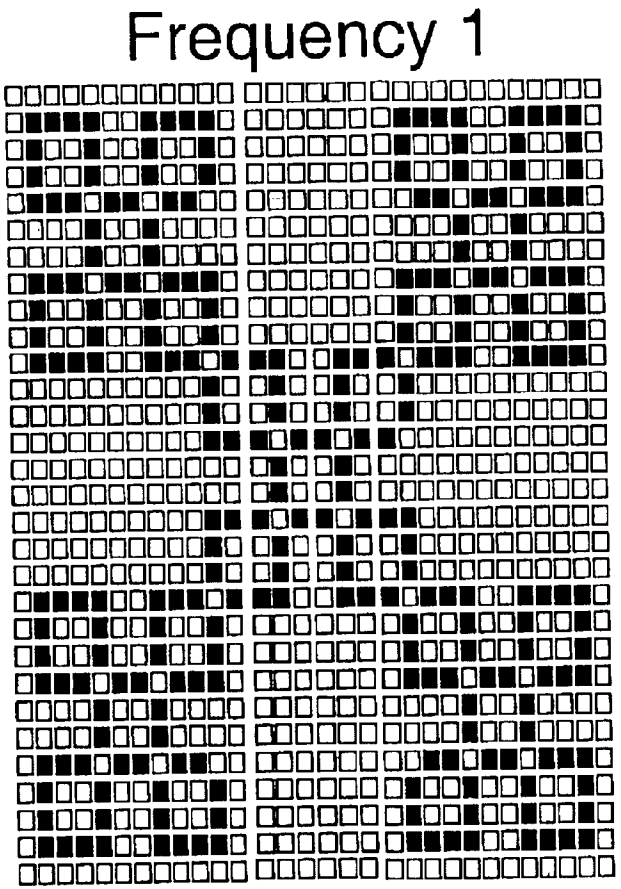
FIG. 20A shows a first frequency response for a reconfigurable array according to the invention.
Figure 21:
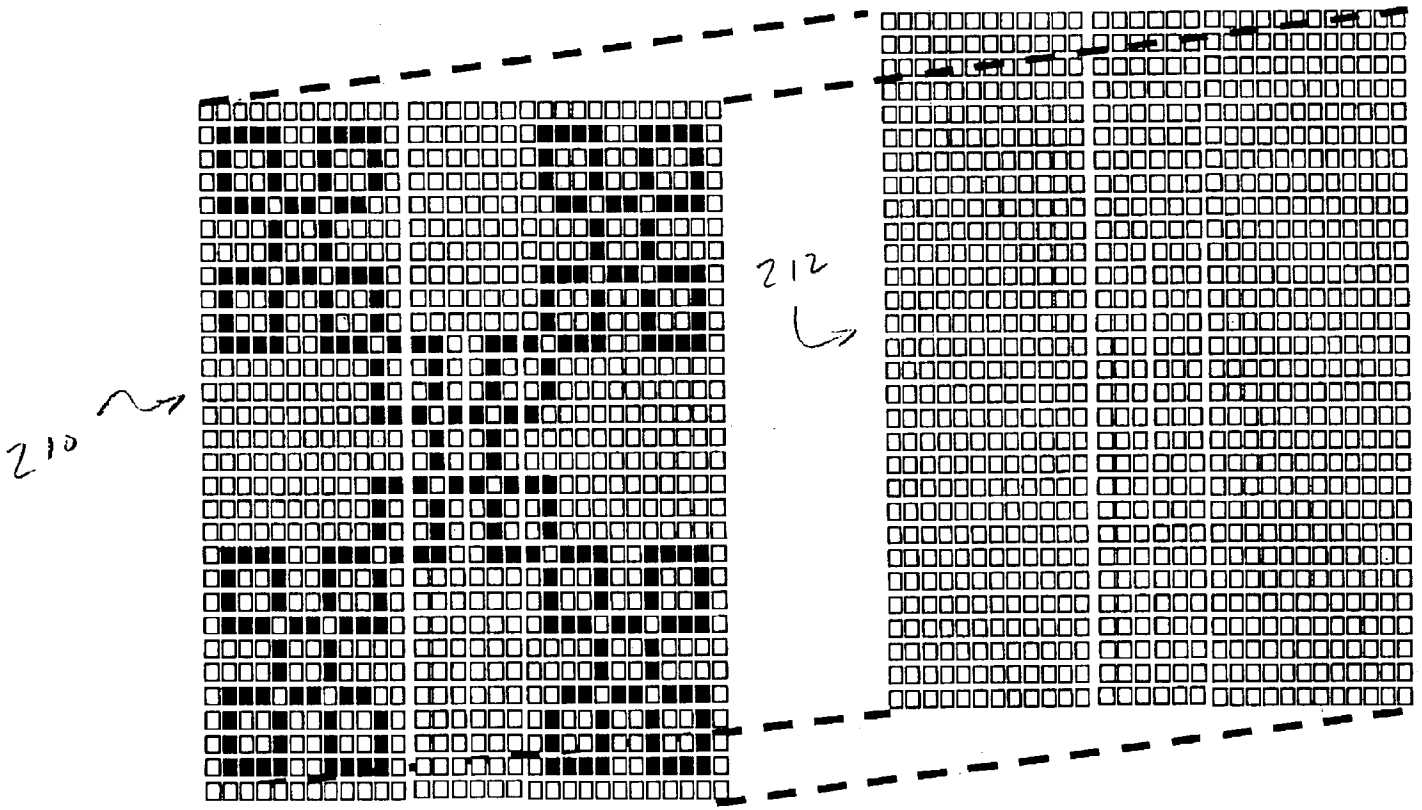
FIG. 21 illustrates the way in which flat-panel technology may be exploited to adaptively activate areas to achieve a reconfigurable antenna pattern according to the invention.

As an alternative to a fixed pattern with switches used to swap elements or change feed points, a reconfigurable multi-dimensional array may be used having an active area optimized to maximize reception for a desired frequency and/or direction. FIG. 20A shows the way in which an array maybe reconfigured for a first frequency, with FIG. 20B showing the way in which the array may be reconfigured for a different frequency. This aspect of the invention may exploit flat-panel technology, as shown in FIG. 21, wherein a transparent conductor array face 210 may be mapped to an addressable interconnect back plane 212 to achieve reconfigurability.

We claim:

1. A method of generating an antenna pattern, comprising the steps of:

defining a set of geometric shapes;

applying different Hutchinson operators to a subset of the geometric shapes to generate a pattern having one or more desirable antenna-related operational characteristics; and implementing the pattern in an electrically conductive medium.

2. The method of claim 1, wherein the pattern is a Hausdorff structure.

3. The method of claim 1, wherein the geometric shapes include rectangles, triangles, and arcs.

4. The method of claim 1, wherein the Hutchinson operators are applied to optimize gain.

5. The method of claim 1, wherein the Hutchinson operators are applied to optimize beam pattern or directionality.

6. The method of claim 1, wherein the Hutchinson operators are applied to optimize polarization response.

7. The method of claim 1, wherein the Hutchinson operators are applied iteratively upon different geometric shapes from the set.

8. The method of claim 7, further including the step of simulating an antenna-related operational characteristic during the iterations.

9. The method of claim 1, wherein the step of implementing the pattern in an electrically conductive medium includes the steps of:

providing an array with switches to reconfigure the array; and activating the switches to implement the pattern.

10. The method of claim 9, wherein the step of activating the switches to implement the pattern includes changing the feed point to alter beam pattern or directionality.

11. An antenna utilizing the pattern of claim 1.

12. An antenna utilizing the pattern of claim 2.

* * * * *